United States Patent [19]

Kalbitz et al.

[11] 3,964,814

[45] June 22, 1976

[54] PLUGGABLE HIGH-AMPERAGE CONTACT

[75] Inventors: Wolfgang Kalbitz; Erwin Keyl, both of Erlangen; Herbert Nitsche, Spardorf; Friedrich Scherbaum, Erlangen, all of Germany

[73] Assignee: Siemens Aktiengesellschaft, Munich, Germany

[22] Filed: Apr. 5, 1974

[21] Appl. No.: 458,406

[30] Foreign Application Priority Data

Apr. 6, 1973 Germany ..... 2317419

[52] U.S. Cl. ..... 339/64 R

[51] Int. Cl.[2] ..... H01R 13/62

[58] Field of Search ..... 339/64–66; 200/248, 258

[56] References Cited

UNITED STATES PATENTS

| | | | |
|---|---|---|---|
| 2,176,718 | 10/1939 | Linde | 339/64 R |
| 2,476,071 | 7/1949 | Spiro | 339/64 R |
| 2,490,037 | 12/1949 | Deiss et al. | 339/64 M |
| 3,070,770 | 12/1962 | Mercier | 339/64 R |
| 3,097,904 | 7/1963 | Yarrick et al. | 339/64 R |
| 3,594,697 | 7/1971 | Azbell | 339/64 R |

*Primary Examiner*—Joseph H. McGlynn
*Attorney, Agent, or Firm*—Kenyon & Kenyon Reilly Carr & Chapin

[57] ABSTRACT

A pluggable high-amperage contact in which the connector receptacle is suspended by means of a joint orientable in all directions with the joint supported so that it is laterally moveable in a plane approximately normal to the longitudinal axis of the plug connector, thereby permitting proper mating of connectors which are not exactly aligned.

12 Claims, 5 Drawing Figures

PLUGGABLE HIGH-AMPERAGE CONTACT

BACKGROUND OF THE INVENTION

This invention relates to pluggable high-amperage contacts in general, and more particularly to an improved contact of this nature which facilitates the mating of a cylindrical plug in a funnel shaped connector receptacle.

Pluggable high-amperage contacts are used in many areas in power engineering. Typically, the plug and the connector receptacle are mounted on different pieces of equipment. As an example, the connector receptacle may be attached to a rectifier or transformer and the plug to a movable frame. Due to the attachment at different pieces of equipment and the large dimensions found in power installations, position tolerances occur between the plug and the connector receptacle. To solve these tolerance problems, commercially available pluggable contacts have been used, in which the connector receptacle is designed to have resilient contact elements. In these previously designed installations, the plug, along with the connector receptacle were accessible after the completion of the installation so that corrections regarding the angular positioning between the plug and the connector receptacle axes as well as major lateral displacements of these axes could be made through proper adjustment. With the increasing demand for compact size and, along therewith, higher power density, equipment designs are frequently found in which the entire equipment such as a rectifier or transformer is placed in an oil-filled vessel. In such cases, the connector receptacle is mounted directly at the high voltage transformer or the like located in the oil tank below the oil level during operation of the equipment. As a result, it is inaccessible from the outside and cannot easily be adjusted. Thus, in installations such as these, proper fitting of a plug and connector receptacle is possible only to a rough degree, if at all, because adjustment can be made only through a relatively small entrance in the oil tank. In addition, a centering element must also be brought through this opening.

Thus, it can be seen that there is a need for a pluggable high-amperage contact which, although positioned within certain tolerances with regard to the center and angular position of the axes of the plug to be plugged into it, is capable of centering the axes of the plug and the axes of the receptacle automatically, when the plug is inserted into the receptacle.

SUMMARY OF THE INVENTION

The present invention solves this problem through the use of a connector receptacle which is suspended by a joint orientable in all directions and which is supported for lateral motion in a plane approximately normal to the longitudinal axis of the plug connector. Through this manner of attachment, as the plug is inserted, lateral compensation of the connector receptacle to line it up with the plug, will first take place. As the plug is pushed further into the connector receptacle, the joint permits automatic equalization of existing tolerances with regard to the mutual angular positions of the two axes.

In general terms, the connector of the present invention includes a base means, a connector receptacle having a funnel shaped entrance portion, first means to suspend the receptable for rotation about two mutually perpendicular axis which are mutually orthogonal to an axis normal to the plane of the base means and second means resting on the base means and supporting the first means with the second means mounted for lateral motion in the plane of the base means and for rotation about the axis normal to the base means thereby permitting the receptacle to be orientatable in all directions and movable laterally in the plane of the base means.

In the illustrated embodiment, a base plate is mounted on supports and a surface plate attached to the base plate using a flange. The joint or first means with the connector receptacle fastened thereto is supported on the surface plate with rollers which form the second means. In this embodiment, the connector receptacle protrudes through cutouts in the base plate and the surface plate such that its axis can swing out of its nominal position by approximately 15°. With a design such as this, it is possible to arrange the entire connector receptacle of the high-amperage contact so that it is laterally movable and orientable as to angular position. This entire arrangement is carried by the above mentioned supports which will preferably be insulators. The movable receptacle is then connected through flexible conductor ribbons to a stationary current carrying bus bar. Through this design, an unequivocal current path between the receptacle and the bus bar is insured. By designing the supports as insulators, the formation of leakage or secondary paths is prevented.

A further feature of the present invention comprises a flange for fastening the base plate which is in the form of a flat ring of rectangular cross section. The surface plate has semicircular cutouts at the places where the flange is fastened to the base plate with screws. By loosening a few screws in the flange, it becomes possible to preadjust the entire arrangement with the connector receptacle in place. Also disclosed is a method for preadjusting the contact in which the connector receptacle is shifted laterally until the center position of its axis is essentially in correspondance with the axis of a centering element introduced and to then adjust the surface plate so that the rollers are arranged under the first support ring, approximately concentrically about a cutout in the center of the surface plate.

Two kinds of joints i.e., first means for suspending the receptacle for rotation about two mutually perpendicular axes are disclosed. One is a two axis gimbal consisting of a first support ring carrying a second support ring through two pins situated on a first axis, with the second support ring carrying the connector receptacle with two pins situated in a second orthogonal axis. This results in a simple and economical embodiment of a joint orientable in all directions. In the second embodiment, the joint or first means is a ball joint, comprising a spherical shell ring, in which the connector receptacle is supported using balls. This type of suspension is particularly advantageous where the nominal position of the axis of the connector receptacle is not at a right angle to the surface of the Earth, i.e., is not vertical. Using this type of joint and additionally creating a neutral center of gravity of the connector receptacle, the desired nominal position can be maintained in a simple manner, if the spherical shell ring is arranged, for example, centrically below the center of gravity of the connector receptacle.

DETAILED DESCRIPTION OF THE PREFERRED EMBODIMENT

Figure 1:
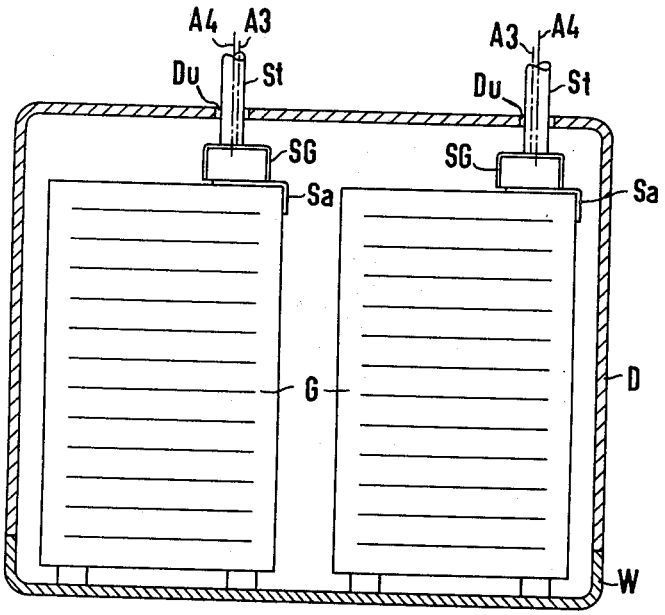
FIG. 1 is a schematic illustration illustrating a high-amperage plug and receptacle.

FIG. 1 is a schematic illustration helpful in understanding the problems involved in receptacles used with high-amperage oil filled devices. In the arrangement illustrated, two high voltage rectifiers G of a high voltage converter are placed in a tray W. Each of the rectifiers has associated therewith, a connector receptacle designated SG which is connected to the rectifier G through a bus bar Sa. When assembly is completed, a cover D is placed over the pan W to form an oil tight enclosure which is then filled with oil. As noted above, high power equipment such as the rectifier G or alternatively, a transformer, are placed in completely closed oil tanks in order to realize a compact design with high power density. Once the cover D is installed, the equipment is accessible only through the openings Du therein. In order to connect the electrical equipment within the oil tank to other equipment, a plug St is inserted from the outside into the connector receptacle SG through the cover. As illustrated, the axes A3 of the receptacles may not line up with the axes A4 of the plugs. The receptacle to be described in detail below, permits this type of operation, causing the two axes to automatically align themselves as the plug is inserted. Although the axes of the plug and receptacle are shown as being vertical in this example, it should be recognized that they may be mounted at an angle. Furthermore, although these plugs and receptacles may be at another point of the equipment, it will be recognized that at any other position where they are below the oil level, considerable sealing problems can arise. In cases where the axes are not vertical, problems can arise in keeping the connector receptacle in its desired position. This can be eliminated by creating a neutral center of gravity for the connector receptacle so that its axis will then be stabilized in the required angular position.

Figure 2:
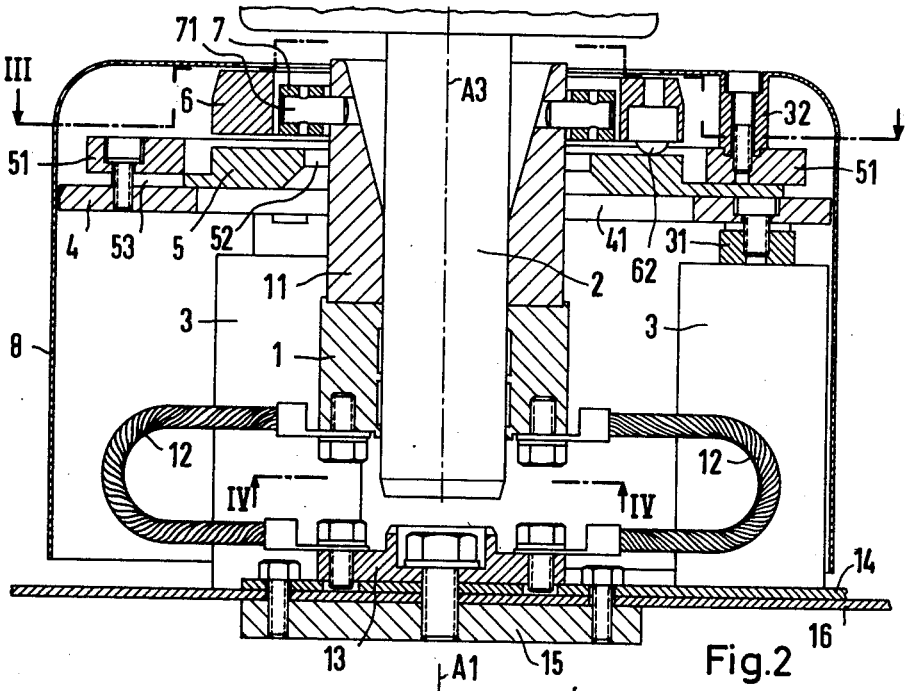
FIG. 2 is a cross sectional elevation view of a first embodiment of a receptacle according to the present invention.

FIG. 2 illustrates a first embodiment of the connector receptacle of the present invention. The receptacle is mounted on the cover or shielding plate 16 of the electrical equipment such as a transformer or a rectifier. Directly connected to this cover or shielding plate 16 is a bus bar 14 which is mounted using a clamping flange 13 and a backing piece 15. The backing piece 15 acts to stiffen the attachment at the thin cover plate 16. Current is conducted through the bus bar 14, the clamping flange 13 and then through flexible conductor ribbons 12 to the jack part 1 of the connector receptacle. As illustrated, the conductor ribbons are attached at the clamping flanges and at the jack part 1. More details of this arrangement will be illustrated in connection with FIG. 4. The movable connector receptacle is supported by three supports designated 3.

Figure 3:
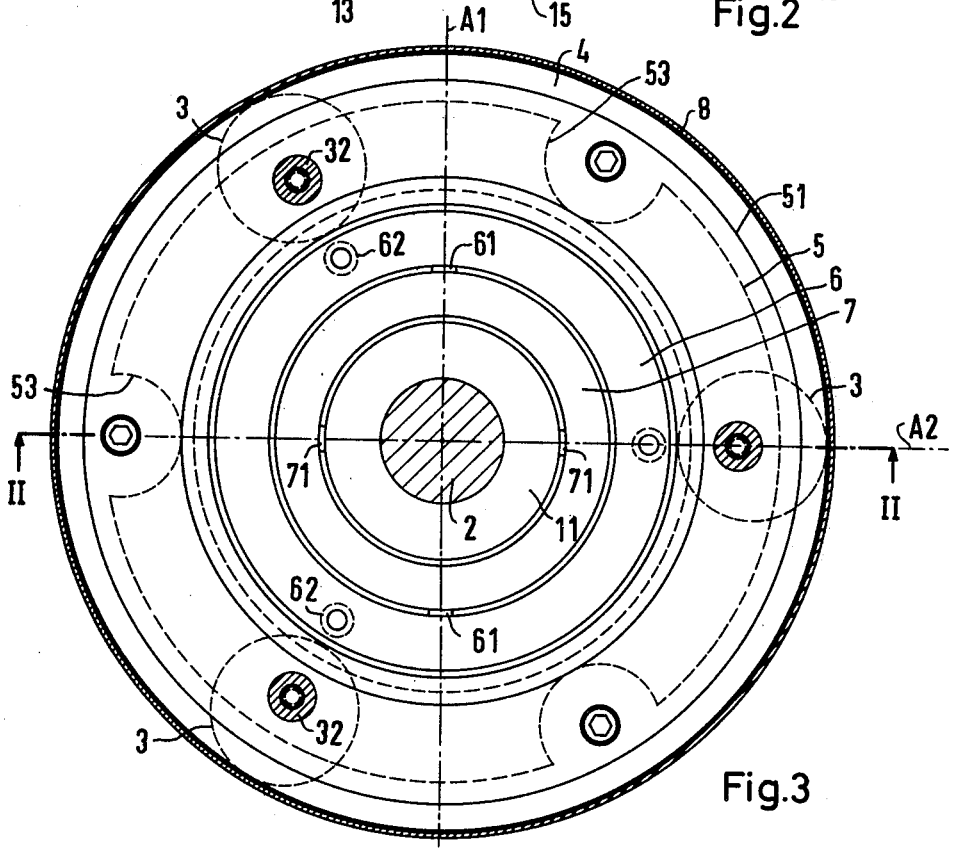
FIG. 3 is a plan view of the receptacle of FIG. 2, along the section III—III.

These are equally spaced about its circumference as illustrated on FIG. 3. These supports will be made of an insulating material to avoid formation of leakage or secondary current paths. A base plate 4 is fastened to the support 3 through an intermediate member 31. Resting on the base plate 4 is a surface plate 5 which is fastened to the base plate by means of a flange 51. At the point where the flange 51 is bolted to the base plate 4, circular cutouts 53 shown on FIG. 3, are provided for reasons to be described in detail below. The base plate 4 and the surface plate 5 have cutouts at their centers designated respectively as 41 and 52. These are larger than the diameter of the central portion of the connector receptacle. This central portion of the connector receptacle which projects through these cutouts is mounted so that it can swing with its axis moving by about 15° in each direction from the nominal position without touching the base plate or the surface plate. The cutouts also permit lateral motion until the edge of the cutouts ie encountered. The flange 51 used in attaching the base plate is in the form of a flat ring of rectangular cross section. A cover and shielding plate 8 is connected to the flange, using spacers 32 to provide protection for the overall receptacle arrangement. The central portion of the receptacle is supported by first means comprising a two axis gimbal system which is then supported on rollers 62 which form the second means which permit rotation about an axis normal to the base and lateral motion in the plane of the base. The rollers 62 permit a lateral shift of the connector receptacle in the plane of the surface of the surface plate. The two axis gimbals comprise a first support ring 6 which carries a second support ring 7 on two pins 61 situated on a first axis A1 shown on FIG. 3. The second support ring carries the connector receptacle made up of the parts 11 and 1 through two pins 71 situated on a second axis A2 which is orthogonal to the first axis. The center portion of the connector receptacle includes the funnel-like guide part 11 and the jack part 1. Within the jack part 1, resilient contact fingers for establishing contact with the plug 2 are attached. For the sake of clarity, these resilient contact fingers which are of conventional design are not shown on the figure.

Referring specifically to FIG. 3 which shows a plan view along the section III—III of FIG. 2, the various elements can be more clearly seen. Thus, going from the outside in, the cover plate 8 is first encountered, then the base plate 4, the flange 51, the surface plate 5 (dashed), the two axis gimbals with the first support ring 6 and the second ring 7, the funnel-like guide part 11 of the receptacle and finally, the plug 2, which is shown in cross section. The orthogonal arrangement of the pins 61 and 71 associated with the gimbals is evident as are the three balls 62 which support the gimbal and permit lateral motion. The aforementioned semicircular cutouts 53 at the point where flange 51 is fastened to the base plate 4, are large enough so that the lateral displacement of the surface plate is possible without removing the fastening screws of the flange 51. Thus, by inserting a centering element into the connector receptacle with the oil tank closed, the surface plate 5 may be adjusted with the flange 51 loosened so that the rollers are arranged under the first support ring 6 to be approximately concentrically about the cutout 52 of the surface plate 5. With this manner of precentering, full freedom of motion in all directions is then possible at the time the plug is inserted into the receptacle. It should be noted, that as a plug 2 is inserted into the funnel portion 11 of the receptacle, if the axis of the plug is not aligned with that of the receptacle, motion will initially occur in a lateral direction to tend to make these two axes line up. As the plug proceeds further, if it is furthermore tilted with respect to the receptacle axis, the gimbals will then permit tilting motion of the receptacle so that good contact is made without placing undue stress on any of the components. Furthermore, this is done without requiring any adjustment within the enclosed oil tank.

Figure 4:
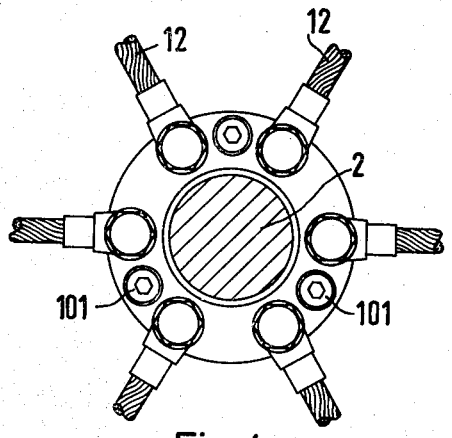
FIG. 4 is a plan view illustrating the connection of the flexible conductor ribbons.

FIG. 4 is a partial view, looking upward along the section IV—IV illustrating the manner in which six flexible conductor ribbons 12 are attached to the jack part 1. Also shown are three screws 101 used for connecting the jack part 1 to the funnel part 11 of FIG. 2.

Figure 5:
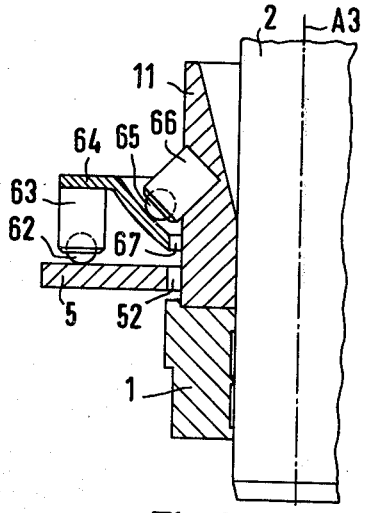
FIG. 5 is a partial cross sectional elevation view of a second embodiment of the present invention.

FIG. 5 is a cross section through a portion of an alternate embodiment of the invention. The primary difference here is that suspension is obtained through the use of a ball joint i.e., the first means comprise a ball joint rather than a two axis gimbal system. The arrangement has rotational symmetry about the axis A3 with the exception that support by the balls 62 and 65 is obtained through the use of three balls, much in the manner illustrated on FIG. 3. Only the portions which are different than the embodiment of FIG. 2 are illustrated. In this embodiment, a spherical shell ring 64 is attached through intermediate members 63 to the balls 62. The intermediate members 63 have appropriate recesses to hold the balls 62 which rest on a surface plate 5, much in the manner described above in connection with FIG. 2. This permits displacement within the limits established by the opening 52 in a plane approximately normal to the longitudinal axis of the plug. The connector receptacle made up of the parts 11 and 1 is supported within the spherical shell ring 64 on three additional balls 65 through intermediate members 66 of a design similar to members 63. It will be recognized that rather than using balls 65, a counterbearing shell could also be used having an outside diameter corresponding to the inside diameter of the spherical shell ring 64. This type of suspension is particularly advantageous where the axis A3 of the connector receptacle and is not to be vertical. In that case, by properly establishing a neutral center of gravity in the connector receptacle, it can be caused to occupy a stable condition with its axis pointing in the desired angular direction.

Thus, an improved high-amperage connector receptacle has been disclosed. Although specific embodiments have been illustrated and described, it will be obvious to those skilled in the art that various modifications may be made without departing from the spirit of the invention which is intended to be limited solely by the appended claims.

What is claimed is:

1. An improved high-amperage connector receptacle of the type wherein the cylindrical plug is inserted into a funnel-like connector receptacle comprising:

a. base means;

b. a connector receptacle having a funnel shaped entrance portion;

c. first means to suspend said receptacle for rotation about two mutually perpendicular axis which axes are mutually orthogonal to an axis normal to the plane of said base means;

d. second means resting on said base means and supporting said first means, said second means mounted for lateral motion in the plane of said base means and for rotation about said axis normal to said base means whereby said receptacle will be orientatable in all directions and movable laterally in the plane of said base means.

2. A receptacle according to claim 1 wherein the cylindrical plug is of a sufficient length that it protrudes beyond said first means suspending said receptacle as viewed from the funnel-shaped entrance portion of said connector receptacle.

3. A receptacle according to claim 1 wherein said receptacle is mounted on electrical equipment and said base means comprise a base plate secured to the equipment by means of supports, a surface plate atop said base plate, a flange coupled mechanically to said base plate securing said surface plate to said base plate and wherein said second means rest on said surface plate through a plurality of balls.

4. A receptacle according to claim 3 wherein the supports supporting said base plate are of an insulating material and further including a bus bar and a plurality of flexible conductor ribbons electrically coupling said bus bar and said connector receptacle.

5. A receptacle according to claim 3 and wherein said connector receptacle projects through cutouts in said base plate and said surface plate and wherein said cutouts are of a size to permit tilting of said receptacle from its normal axis of 15° in any direction.

6. A receptacle according to claim 5 wherein the supports supporting said base plate are of an insulating material and further including a bus bar and a plurality of flexible conductor ribbons electrically coupling said bus bar and said connector receptacle.

7. A receptacle according to claim 6 wherein said flange is made in the shape of a flat ring of rectangular cross section.

8. A receptacle according to claim 7 wherein said flange is fastened to said base plate with a plurality of screws and further including semicircular cutouts in said surface plate at the points where said flange is fastened to said base plate.

9. A receptacle according to claim 5 wherein said first means is a two-axis gimbal system.

10. A receptacle according to claim 9 wherein said two-axis gimbal system comprises a first support ring, a second support ring, two pins located along a first axis coupling said first and second support rings, and third and fourth pins situated along a second axis orthogonal to said first axis coupling said second support ring and said connector receptacle.

11. A receptacle according to claim 5 wherein said first means comprises a ball joint.

12. A receptacle according to claim 11 wherein said ball joint comprises a spherical shell ring and wherein said connector receptacle is supported in said shell ring by balls.

* * * * *